US007095182B2

(12) United States Patent
Ando et al.

(10) Patent No.: US 7,095,182 B2
(45) Date of Patent: Aug. 22, 2006

(54) IGNITION CONTROL APPARATUS FOR INTERNAL COMBUSTION ENGINE

(75) Inventors: Koji Ando, Kariya (JP); Haruo Kawakita, Okazaki (JP)

(73) Assignee: Denso Corporation, Kariya (JP)

( * ) Notice: Subject to any disclaimer, the term of this patent is extended or adjusted under 35 U.S.C. 154(b) by 57 days.

(21) Appl. No.: 11/007,239

(22) Filed: Dec. 9, 2004

(65) Prior Publication Data

US 2005/0146822 A1 Jul. 7, 2005

(30) Foreign Application Priority Data

Dec. 18, 2003 (JP) ..... 2003-421343

(51) Int. Cl.
*F02B 3/04* (2006.01)

(52) U.S. Cl. ..... 315/209 T; 123/630; 361/93.8

(58) Field of Classification Search ..... 315/209 M, 315/209 R, 209 T; 123/481, 630, 644, 424; 361/93.8
See application file for complete search history.

(56) References Cited

U.S. PATENT DOCUMENTS 4,077,379 A * 3/1978 Jundt et al. ..... 123/645
5,309,884 A * 5/1994 Fukui et al. ..... 123/481
5,494,016 A * 2/1996 Okumura et al. ..... 123/406.53
5,664,550 A 9/1997 Ito et al. ..... 123/630
6,684,867 B1 2/2004 Ito et al. ..... 123/644

* cited by examiner

*Primary Examiner*—Tuyet Vo
*Assistant Examiner*—Jimmy Vu
(74) *Attorney, Agent, or Firm*—Nixon & Vanderhye P.C.

(57) ABSTRACT

An ignition control apparatus for an internal combustion engine of the present invention has a switching circuit and a control circuit. The switching circuit includes a first switch controlling a main current constituting the most portion of the coil current, a second switch controlling a sensing current constituting the coil current together with the main current; and a temperature sensor detecting temperatures of the first and the second switches, which are realized by semiconductors. The control circuit, which is heat-isolated from the switching circuit, includes a current limiting circuit operating the first switch and the second switch to adjust the coil current to a predetermined value based on the sensing current, and a thermal shutoff circuit turning off both the first switch and the second switch when the temperature detected by the temperature sensor exceeds a predetermined threshold value.

7 Claims, 3 Drawing Sheets

IGNITION CONTROL APPARATUS FOR INTERNAL COMBUSTION ENGINE

CROSS REFERENCE TO RELATED APPLICATIONS

This application is based upon and claims the benefit of priority of Japanese Patent Application No. 2003-421343 filed on Dec. 18, 2003, the contents of which are incorporated herein by reference.

FIELD OF THE INVENTION

The present invention relates to an ignition control apparatus for an internal combustion engine.

BACKGROUND OF THE INVENTION

Some kind of ignition apparatus has IGBT (insulated gate bipolar transistor), which is a switching semiconductor, therein to control a current through an ignition coil connected with a spark plug. A short circuit or a contact of a wiring for controlling the IGBT with a power supply wiring makes control signal sent from an ECU (electrical control unit) continue for a long period of time to keep turning on the IGBT. In this case, the IGBT generates much heat, so as to break itself, that is, to cause a short circuit between the collector and the emitter thereof. Then, the IGBT flows a current continuously through a primary winding of the ignition coil, so that the ignition coil overheats to break itself.

U.S. Pat. No. 5,664,550B (JP3216972B) discloses an apparatus comprising an IGBT, a control circuit generating a control signal for the IGBT and a heat detection circuit, which detects a predetermined high level of heat generation at the IGBT. When the heat detection circuit detects the predetermined high level of heat, the detection circuit turns off the IGBT automatically. When a temperature of the IGBT falls down to the predetermined level again, a latch circuit continues to keep the control signal turned off to prevent the current through the IGBT from flowing without sufficient fall of the temperature in the IGBT. The IGBT keeps turned off until the control circuit determines to turn on the IGBT again.

Further, in the above apparatus, another IGBT takes out a little portion of the current through the ignition coil to detect the current value through the IGBT controlling the current through the ignition coil. Then a current limiting circuit controls a gate voltage of the IGBTs based on the current value. Thus, the current through the ignition coil settles at a predetermined level.

However, sometimes the heat generation at the ignition coil precedes the heat generation at the IGBTs due to high ambient temperatures and large resistance of the primary winding of the ignition coil is relatively large. In this case, the heat generation increases the resistance of the coil, so that the current is determined not by the current limiting circuit but by the resistance of the coil. Thus, the IGBTs operate in a saturation region, and the heat generation at the IGBTs is relatively small, without making the temperature of the die locating the IGBTs high. Accordingly, the heat detection circuit fails to turn off the IGBTs, so that the current keeps flowing through the ignition coil, and the ignition coil breaks by the heat generation thereof.

SUMMARY OF THE INVENTION

The present invention has an object to provide an ignition control apparatus capable of reliably preventing an ignition coil from breaking by the heat generation thereof.

An ignition control apparatus for an internal combustion engine according to the present invention comprises a switching circuit and a control circuit.

The switching circuit includes a first switching device switching a main current constituting the most portion of the coil current, a second switching device switching a sensing current constituting the coil current together with the main current; and a temperature sensor detecting a temperature of the first switching device and a temperature of the second switching device.

The control circuit, which is heat-isolated from the switching circuit, includes a current limiting circuit operating the first switching device and the second switching device to adjust the coil current to a predetermined value based on the sensing current, and a thermal shutoff circuit turning off both the first switching device and the second switching device when the temperature detected by the temperature sensor exceeds a predetermined threshold value.

BRIEF DESCRIPTION OF THE DRAWINGS

Other features and advantages of the present invention will be appreciated, as well as methods of operation and the function of the related parts, from a study of the following detailed description, appended claims, and drawings, all of which form a part of this application. In the drawings:

DETAILED DESCRIPTION OF THE PREFERRED EMBODIMENTS

First Embodiment

Figure 1:
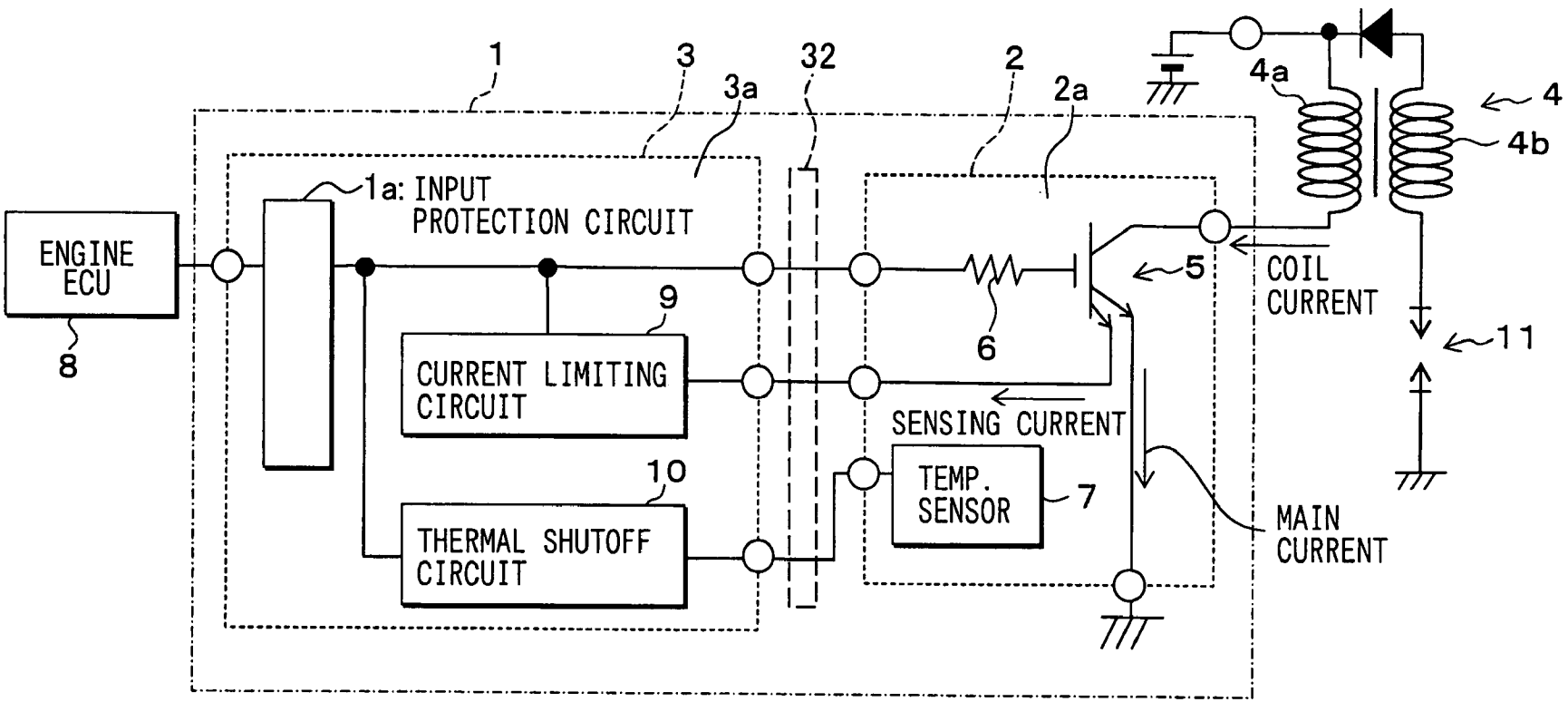
FIG. 1 is a schematic circuit diagram of an ignition control apparatus according to the first embodiment of the present invention.

FIG. 1 depicts an ignition control apparatus 1 for an internal combustion engine of a vehicle, the apparatus 1 has a switching IC 2 and a control IC 3 therein. The switching IC 2 and the control IC 3 are provided on dies (chip substrates 2*a* and 3*a*), which are separated from each other by heat-insulating material 32 such as plastics and adhesives whose heat-transfer ratio is lower than that of metals, not to transfer heat therebetween.

The switching IC 2 controls a value of a coil current flowing through a primary winding 4*a* of an ignition coil 4. The switching IC 2 has two IGBTs 5 and a resistor 6 therein.

The IGBTs 5 control the value of the coil current. One of the IGBTs 5, which is on a main cell, flows most portion of the coil current (main current). The other of the IGBTs 5, which is on a current detection cell, flows the rest of the coil current (sensing current), which is for detecting a value of the main current and that of the sensing current, that is, the value of the coil current. A control signal sent from the control IC 3 determines gate voltages of the IGBTs 5. One IGBT 5 flowing the main current serves as the first switching device, and the other IGBT 5 flowing the sensing current serves as the second switching device.

Collectors of the IGBTs 5 are formed in one terminal and connected to the primary winding 4*a*. An emitter of one IGBT 5 flowing the main current is grounded and an emitter of the other IGBT 5 flowing the sensing current is connected to the control IC 3. Thus, the sensing current, which is proportionate to the main current, is fed back to the control IC 3.

As a temperature of the switch IC 2 increases, the ratio of the sensing current to the main current becomes larger. This is because the gradient of the Vg-Ic (gate voltage—collector current) characteristic of each IGBT 5 gradually decreases as the temperature thereof increases, decreasing an influence by the resistance of a current detection cell. Thus, the sensing current has a positive characteristic to temperature.

The resistor 6 is connected to the gate of the IGBT 5.

The switching IC 2 has a temperature sensor 7 therein. The temperature sensor 7 detects a temperature increase of the switching IC 2 by the heat generation of the IGBT 5, and serves a feedback of the temperature to the control IC 3.

While, the control IC 3 sends an ignition signal from an engine ECU 8 to the switching IC 2 as the control signal for the IGBTs 5. The control IC 3 has an input protection circuit 1*a*, a current limiting circuit (constant current control circuit) 9 and a thermal shutoff circuit 10, which adjust the control signal for the IGBTs 5 based on both of the coil current through the primary winding 4*a* and the temperature of the switching IC 2.

The current limiting circuit 9 receives the sensing current and adjusts the gate voltage of the IGBTs 5 based on the value of the sensing current. For example, the current limiting circuit 9 transforms by a resistor not shown in the FIG. 1 the sensing current into a voltage, and adjusts the gate voltage of the IGBTs 5 based on the change of the voltage, so that the coil current may be controlled to a constant value. The current limiting circuit 9 is capable of adjusting the gate voltage of the IGBTs 5 based on the temperatures of the die composing the control IC3, which is heat-insulated from the die composing the switching IC 2.

The current limiting circuit 9 has a power source generating a reference voltage, a comparator, a diode having a characteristic for heat-compensating the voltage value of the reference voltage, and so on. The comparator compares the reference voltage heat-compensated by the diode with the voltage transformed from the sensing current, and generates output for controlling the gate voltage.

The thermal shutoff circuit 10 receives the detection signal of the temperature sensor 7 located in the switching IC 2, and controls the gate voltage of the IGBTs 5 to be turned off when the temperature of the switching IC2 exceeds a predetermined value.

The primary winding 4*a* of the ignition coil 4 is connected to the collectors of IGBTs 5 located in the switching IC 2, and the secondary winding 4*b* of the ignition coil 4 is connected to a plug 11, so as to control the spark timing of the plug 11 by the ignition control apparatus 1.

Figure 2A:
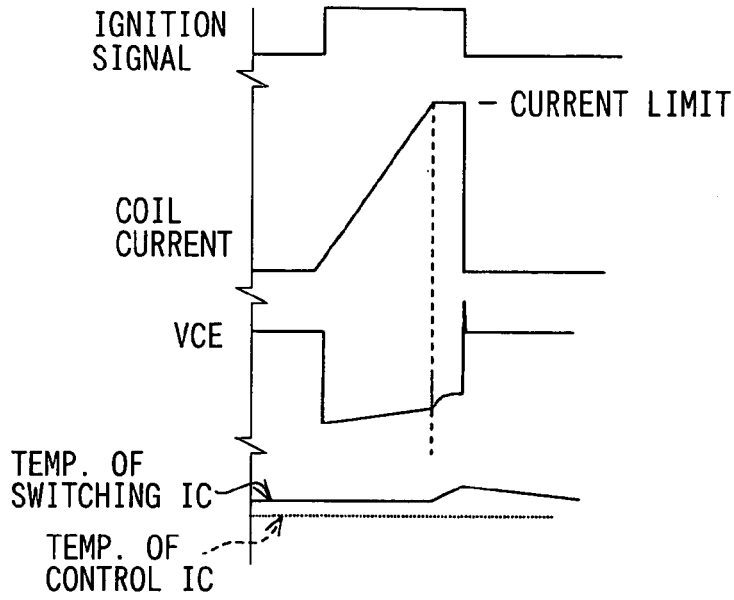
FIG. 2A is a timing chart of the ignition control apparatus under a normal condition according to the first embodiment.
Figure 2B:
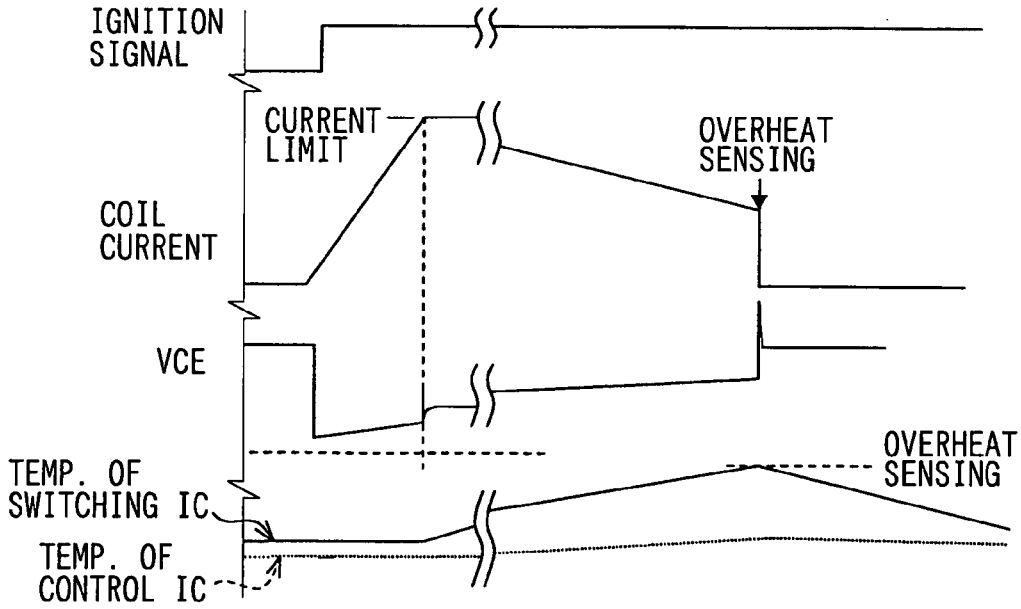
FIG. 2B is a timing chart of the ignition control apparatus under a lock condition according to the first embodiment.

The operation of the ignition control apparatus 1 of this embodiment is described below with reference to timing charts shown in FIGS. 2A and 2B. FIGS. 2A and 2B respectively depict an operation of the ignition control apparatus 1 in case of normal condition and current lock condition.

As shown in FIG. 2A, when the ignition signal from the engine ECU 8 is high, the control IC 3 turns on the IGBTs 5 by applying via the resistor 6 a high gate voltage thereto. Thus, a current flows between the collector and the emitter of each IGBT 5, so as to progressively increase the coil current through the primary winding 4*a* of the ignition coil 4. When the ignition signal is low, the control IC 3 turns off the IGBTs 5 by decreasing the gate voltages applied thereto, so as to sharply interrupt the coil current through the primary winding 4*a* for a high voltage generation.

During this period of time, the heat generation at the IGBTs 5 according to the flowing time of the coil current increases the potential drop (VCE in FIGS. 2A and 2B) in the IGBTs 5 between the collector and the emitter thereof, while the coil current also increases gradually. When the coil current exceeds the predetermined value, the coil current is regulated to the predetermined value by the current limiting circuit 9.

However, the ignition signal is set high normally in a short period of time, and the coil current is merely regulated by the current limiting circuit 9, just causing a heat generation at the switching IC 2 to some degree. Thus, the switching IC 2 and the control IC3 operate generally in a close temperature condition, so that the difference is small between temperature-current characteristic of the sensing current through the IGBT 5 and the heat compensation value of the current limiting operation by the control IC 3. Accordingly, the current limiting circuit 9 controls the coil current to the predetermined limit value with a high accuracy.

Whereas, as shown in FIG. 2B, when the ignition signal from the engine EGU 8 continues to be high for some reason, the coil current keeps increasing. When the coil current exceeds the predetermined limit value, the coil current is adjusted to the predetermined value by the current limiting circuit 9 and remains for a long time.

During this period of time, the coil current keeps flowing, and the heat generation at the IGBTs 5 is quite large, increasing the difference between the temperature of the switching IC 2 and that of the control circuit 3. Thus, the positive temperature-current characteristic of the sensing current at the IGBT 5 keeps increasing, while the temperature compensation by the control IC 3 is kept small. Accordingly, the gate voltages of the IGBTs 5 are controlled so as to decrease the coil current as the time passes. That is, the heat-current characteristic of the coil current to the temperature of the switching IC 2, operated by the current limiting circuit 9, is negative.

As a result, each of the IGBTs 5 operates in a pinch-off region, so as to make the potential drop and the heat generation at the IGBT 5 larger. Thus, the heat generation at the IGBTs 5 precedes the heat generation at the ignition coil 4 caused by the coil current, restraining the coil current and the overheat at the ignition coil 4.

Then, the heat generation at the IGBT 5 increases the temperature of the switching IC 2. The temperature sensor 7 detects whether the temperature of the switching IC 2 is over a predetermined value, and the thermal shutoff circuit 10 controls the gate voltage of the IGBT 5 to turn off the IGBT 5 when the detected temperature exceeds the predetermined value.

The heat difference between the switching IC 2 and the control IC 3 makes it possible for the heat generation at the IGBTs 5 precedes the heat generation at the ignition coil 4, so as to limit the coil current through the ignition coil 4 to prevent the ignition coil 4 from breaking by its overheating.

Second Embodiment

Figure 3:
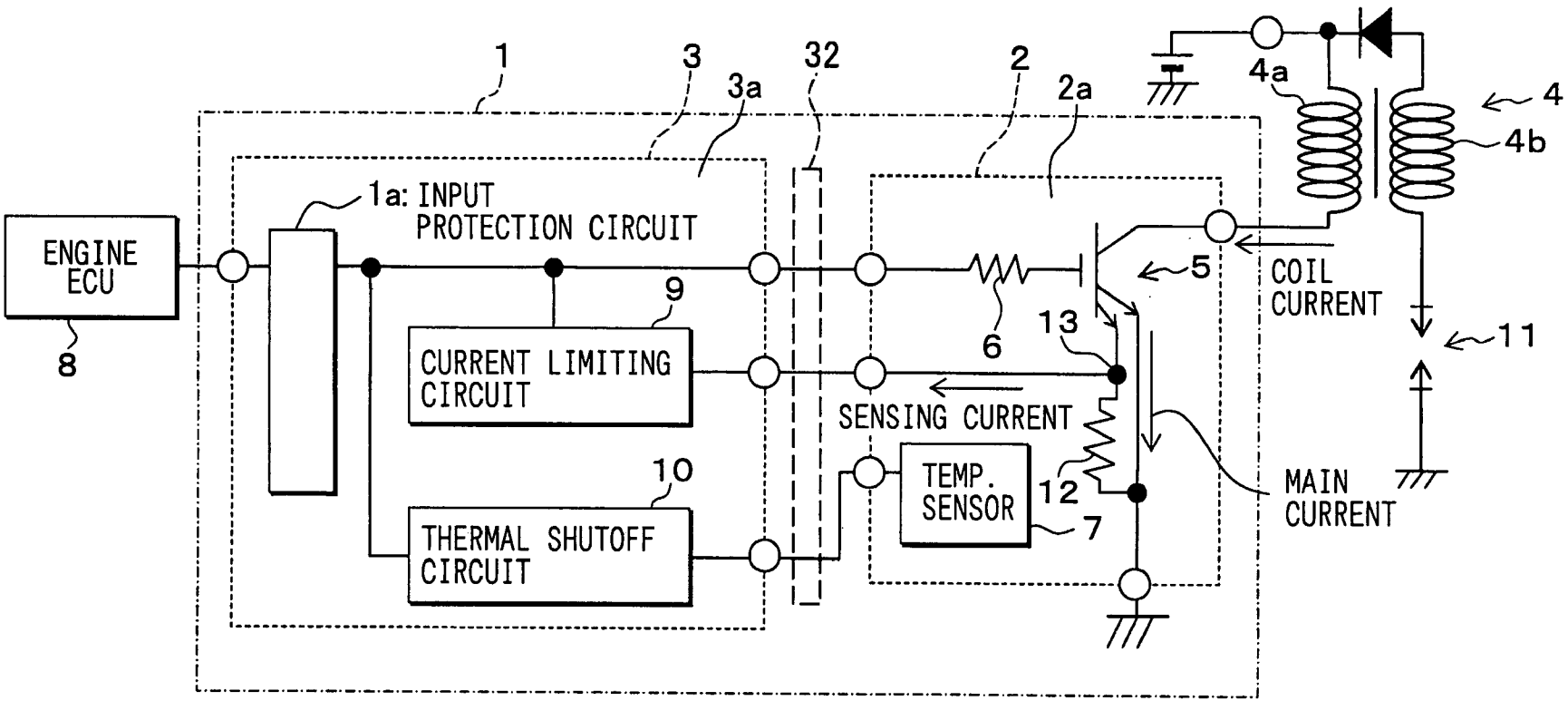
FIG. 3 is a schematic circuit diagram of an ignition control apparatus according to the second embodiment of the present invention.

FIG. 3 depicts a circuit diagram of an ignition control apparatus 1 of this embodiment. This embodiment of ignition control apparatus 1 has a configuration modified from that of the ignition control apparatus 1 of the first embodiment, whose main part is configured same as that of the first embodiment.

The ignition control apparatus 1 of this embodiment has a current detection resistor 12 in the switching IC 2. The current detection resistor 12 is connected to the emitter of the IGBT 5 on the current detection cell. The current detection resistor 12 detects a value of the sensing current, which is proportionate to a value of the main current.

The current detection resistor 12 has a positive temperature-resistance characteristic, for example by comprising a diffused resistor. A feedback of a potential at a junction 13, which is located between the current resistor 12 and the emitter of the IGBT 5 flowing the sensing current, to the control IC 3 transmits a value of the main current through the IGBT 5 to the control IC 3.

The ignition control apparatus 1 having the above configuration inputs into the current limiting circuit 9 the potential at the junction 13 including the positive temperature-resistance characteristic of the current detection resistor 12 in addition to the positive temperature-current characteristic of the sensing current. Thus, a difference between the temperature-current characteristic of the sensing current and the temperature compensation of the control IC 3 becomes larger, so as to reduce the current controlling level set at the current limiting circuit 9.

Accordingly, the coil current through the ignition coil 4 is limited to a lower value, so as to prevent the ignition coil 4 from breaking by its overheating.

What is claimed is:

1. An ignition control apparatus, which controls a flow of a coil current through an ignition coil of an internal combustion engine, comprising:

a switching circuit including;

a first switching device switching a main current constituting the most portion of the coil current, a second switching device switching a sensing current constituting the coil current together with the main current, and a temperature sensor detecting a temperature of the first switching device and a temperature of the second switching device, and a control circuit heat-isolated from the switching circuit and including;

a current limiting circuit operating the first switching device and the second switching device to adjust the coil current to a predetermined value based on the sensing current, and a thermal shutoff circuit turning off both the first switching device and the second switching device when the temperature detected by the temperature sensor exceeds a predetermined threshold value.

2. The ignition control apparatus according to claim 1, wherein the control circuit is heat-isolated from the switching circuit by at least one of plastic and adhesive agent.

3. The ignition control apparatus according to claim 1, wherein:

the current limiting circuit has a temperature-current characteristic depending on a temperature of the control circuit; and the current limiting circuit operates to compensate for the temperature-current characteristic thereof.

4. The ignition control apparatus according to claim 1, wherein the current limiting circuit operates to lower the coil current as a temperature of the switching circuit becomes higher than that of the control circuit.

5. The ignition control apparatus according to claim 1, wherein the current limiting circuit operates to lower the coil current as a temperature of the switching circuit increases relative to a temperature of the control circuit.

6. The ignition control apparatus according to claim 1, wherein the switching circuit further includes a current detection resistor having a positive temperature-current characteristic and connected to the first switching device to flow a portion of the sensing current for detecting the value of the sensing current flowing in the second switching device.

7. An ignition control apparatus for an ignition coil of an internal combustion engine, the apparatus comprising:

a switching circuit having a switching transistor connected to the ignition coil to supply a coil current in response to a control signal, and a temperature sensor for detecting a temperature of the switching transistor; and a control circuit heat-isolated from the switching circuit and having a current limit circuit for feedback-controlling the coil current flowing through the switching transistor, and a shutoff circuit for shutting off the switching transistor irrespective of the control signal when the temperature sensor detects that the temperature of the switching transistor exceeds a predetermined value.

* * * * *